US008646679B2

(12) United States Patent
Hill et al.

(10) Patent No.: US 8,646,679 B2
(45) Date of Patent: Feb. 11, 2014

(54) SECURITY COLLAR FOR BEVERAGE CONTAINER

(76) Inventors: Webb LeRon Hill, Toledo, OH (US); Richard Ira Rosenberg, Roslyn Heights, NY (US); Thomas George Murray, Hasbrock Heights, NJ (US)

( * ) Notice: Subject to any disclaimer, the term of this patent is extended or adjusted under 35 U.S.C. 154(b) by 376 days.

(21) Appl. No.: 13/027,305

(22) Filed: Feb. 15, 2011

(65) Prior Publication Data

US 2011/0253774 A1 Oct. 20, 2011

Related U.S. Application Data

(60) Provisional application No. 61/324,813, filed on Apr. 16, 2010.

(51) Int. Cl.
*B65D 5/74* (2006.01)

(52) U.S. Cl.
USPC ..... 229/117.3; 229/117.35; 229/117.15

(58) Field of Classification Search
USPC ..... 229/117.3, 117.35, 117.15
See application file for complete search history.

(56) References Cited

U.S. PATENT DOCUMENTS

| | | | | |
|---|---|---|---|---|
| 3,349,986 | A | 10/1967 | Chapman et al. | |
| 5,054,644 | A * | 10/1991 | Greenslade | 229/117.3 |
| 5,125,566 | A | 6/1992 | Deiger | |
| 5,715,992 | A | 2/1998 | Andrews, Sr. et al. | |
| 5,909,841 | A | 6/1999 | Andrews, Sr. et al. | |
| 6,053,401 | A | 4/2000 | Andrews, Sr. | |
| 6,196,452 | B1 | 3/2001 | Andrews, Sr. et al. | |
| 6,253,993 | B1 * | 7/2001 | Lloyd et al. | 229/117.3 |
| 6,290,124 | B2 | 9/2001 | Andrews, Sr. et al. | |
| 7,007,825 | B2 | 3/2006 | Crosland et al. | |
| 7,077,309 | B2 | 7/2006 | Andrews, Sr. | |
| 7,344,052 | B2 | 3/2008 | Light | |
| 7,389,909 | B2 | 6/2008 | Crosland et al. | |
| 7,571,835 | B2 | 8/2009 | Hill et al. | |
| 2008/0023359 | A1 * | 1/2008 | Churvis et al. | 206/386 |
| 2009/0101699 | A1 | 4/2009 | Goudreau et al. | |

* cited by examiner

*Primary Examiner* — Nathan J Newhouse
*Assistant Examiner* — Scott McNurlen
(74) *Attorney, Agent, or Firm* — Fraser Clemens Martin & Miller LLC; J. Douglas Miller

(57) ABSTRACT

A fluid container includes an outer shell including a plurality of sidewalls forming a hollow interior, a first one of the sidewalls having an opening formed therein and a first flap extending therefrom, the first flap having a retention feature formed therein, and an inner liner disposed within the hollow interior of the outer shell configured to receive and store a fluid, the inner liner including a spout providing fluid communication with an interior thereof, wherein the retention feature is in substantial alignment with a portion of the opening formed in the first one of the sidewalls, the opening and the retention feature cooperating to receive and support the spout in a position extending outwardly from the first one of the sidewalls.

20 Claims, 7 Drawing Sheets

SECURITY COLLAR FOR BEVERAGE CONTAINER

CROSS REFERENCE TO RELATED APPLICATIONS

This application is entitled to claim the benefit of, and claims priority to, U.S. provisional patent application Ser. No. 61/324,813 filed Apr. 16, 2010, the entire disclosure of which is incorporated herein by reference.

FIELD OF THE INVENTION

The invention relates to a beverage container and more particularly to a security collar for a spout of a beverage container.

BACKGROUND OF THE INVENTION

Food retailers such as caterers and coffee shops often provide beverages such as coffee and tea, for example, in a disposable container. One such disposable container is described in U.S. Pat. No. 6,253,993 which shows a collapsible box with a flexible bag contained therein. The bag includes a pour spout providing fluid communication into an interior of the bag. The spout extends through an aperture formed in a wall of the box and extends outwardly therefrom. Typically, a spout retention member is provided that is removably attached to the box and the pour spout to facilitate retaining the pour spout in a position extending outwardly from the wall of the box.

The spout retention member is often a separate member that is attached to the assembled container and, thus, can be misplaced before final assembly, and can be separated from the box and lost after final assembly. Other containers employ a retention member that is integrally formed with the final assembled container. Such containers often require additional assembly steps that increase a time and complexity of assembly. Further, such containers often require additional material to form the container, thus, increasing a cost thereof.

It would be desirable to produce a security collar for a spout of a beverage container, wherein retention of the spout in a position extending outwardly from a wall of the box is maximized, an ease of assembling the beverage container is maximized, and a material needed to form the container is minimized.

SUMMARY OF THE INVENTION

Concordant and consistent with the present invention, a security collar for a spout of a beverage container, wherein retention of the spout in a position extending outwardly from a wall of the box is maximized, an ease of assembling the beverage container is maximized, and a material needed to form the container is minimized, has surprisingly been discovered.

In one embodiment, the fluid container comprises: an outer shell including a plurality of sidewalls forming a hollow interior, a first one of the sidewalls having an opening formed therein and a first flap extending therefrom, the first flap having a retention feature formed therein; and an inner liner disposed within the hollow interior of the outer shell configured to receive and store a fluid, the inner liner including a spout providing fluid communication with an interior thereof, wherein the retention feature is in substantial alignment with a portion of the opening formed in the first one of the sidewalls, the opening and the retention feature cooperating to receive and support the spout in a position extending outwardly from the first one of the sidewalls.

In another embodiment, the fluid container comprises: an outer shell including a plurality of sidewalls forming a hollow interior, a first one of the sidewalls having a first flap extending therefrom, wherein the first flap has a retention feature formed therein, and an opening is formed in at least one of the first one of the sidewalls and the first flap; and an inner liner disposed within the hollow interior of the outer shell configured to receive and store a fluid, the inner liner including a spout providing fluid communication into an interior thereof, wherein the spout is positioned to extend through the opening formed in the first one of the sidewalls and the first flap includes at least one fold line about which the flap is folded to position the retention feature around at least a portion of spout, the opening and the retention feature cooperating to support the spout in a position extending outwardly from the first one of the sidewalls.

The present invention also includes methods of forming a fluid container.

One method comprises the steps of: providing a blank including a plurality of panels, a first one of the panels having an opening formed therein and a first flap extending from the first one of the panels, wherein the first flap has a retention feature formed therein; arranging the panels to form an outer shell having a hollow interior; disposing an inner liner in the hollow interior of the outer shell, the inner liner including a spout providing fluid communication with an interior thereof, wherein the spout is positioned to extend through the opening formed in the first one of the panels; and folding the first flap upon itself to position the retention feature around at least a portion of spout, the opening and the retention feature cooperating to support the spout in a position extending outwardly from the first one of the panels.

BRIEF DESCRIPTION OF THE DRAWINGS

The above advantages of the invention will become readily apparent to those skilled in the art from reading the following detailed description of an embodiment of the invention in the light of the accompanying drawings, in which.

DETAILED DESCRIPTION OF THE PREFERRED EMBODIMENT OF THE INVENTION

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
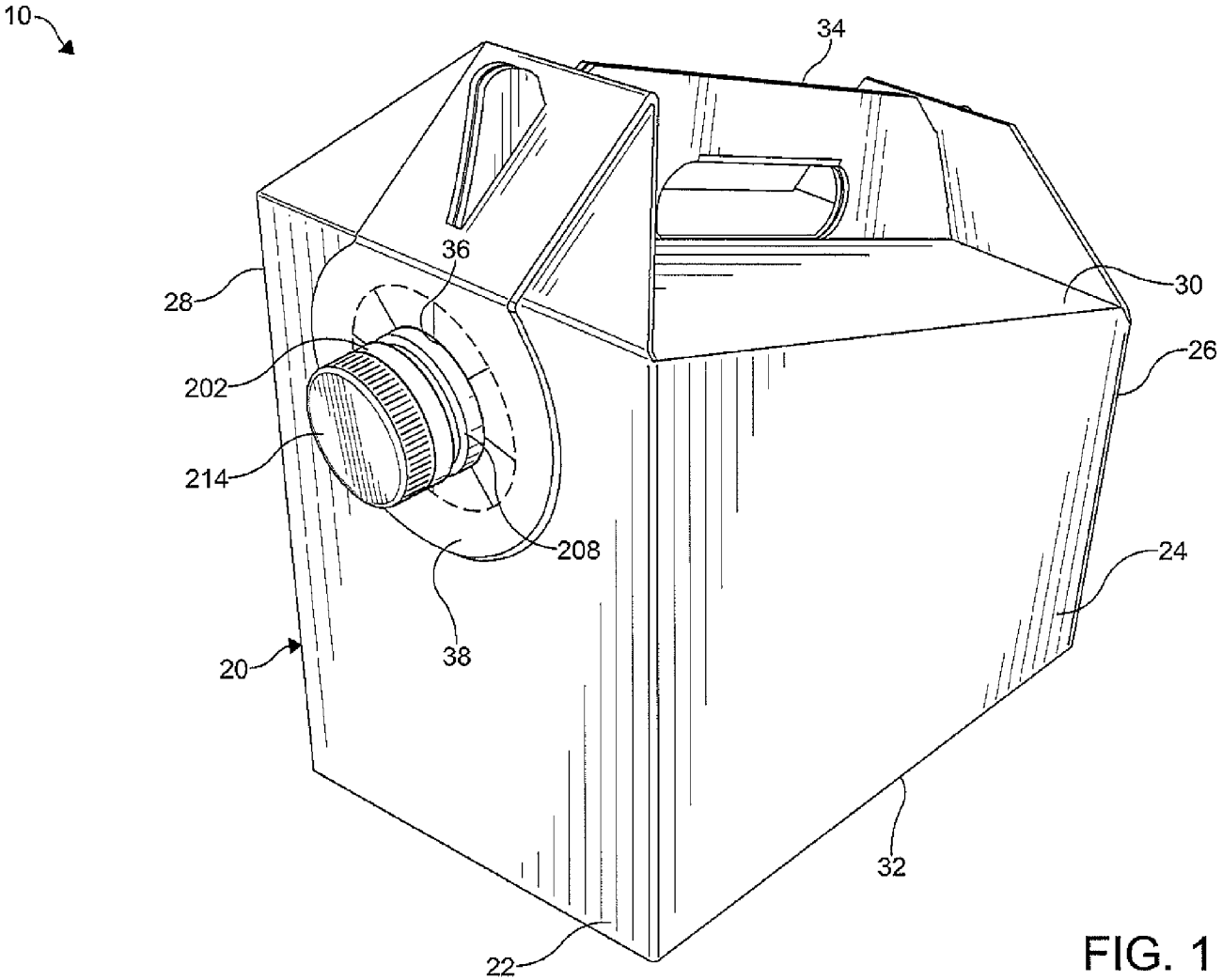
FIG. 1 is a perspective view of a beverage container according to an embodiment of the invention.
Figure 2:
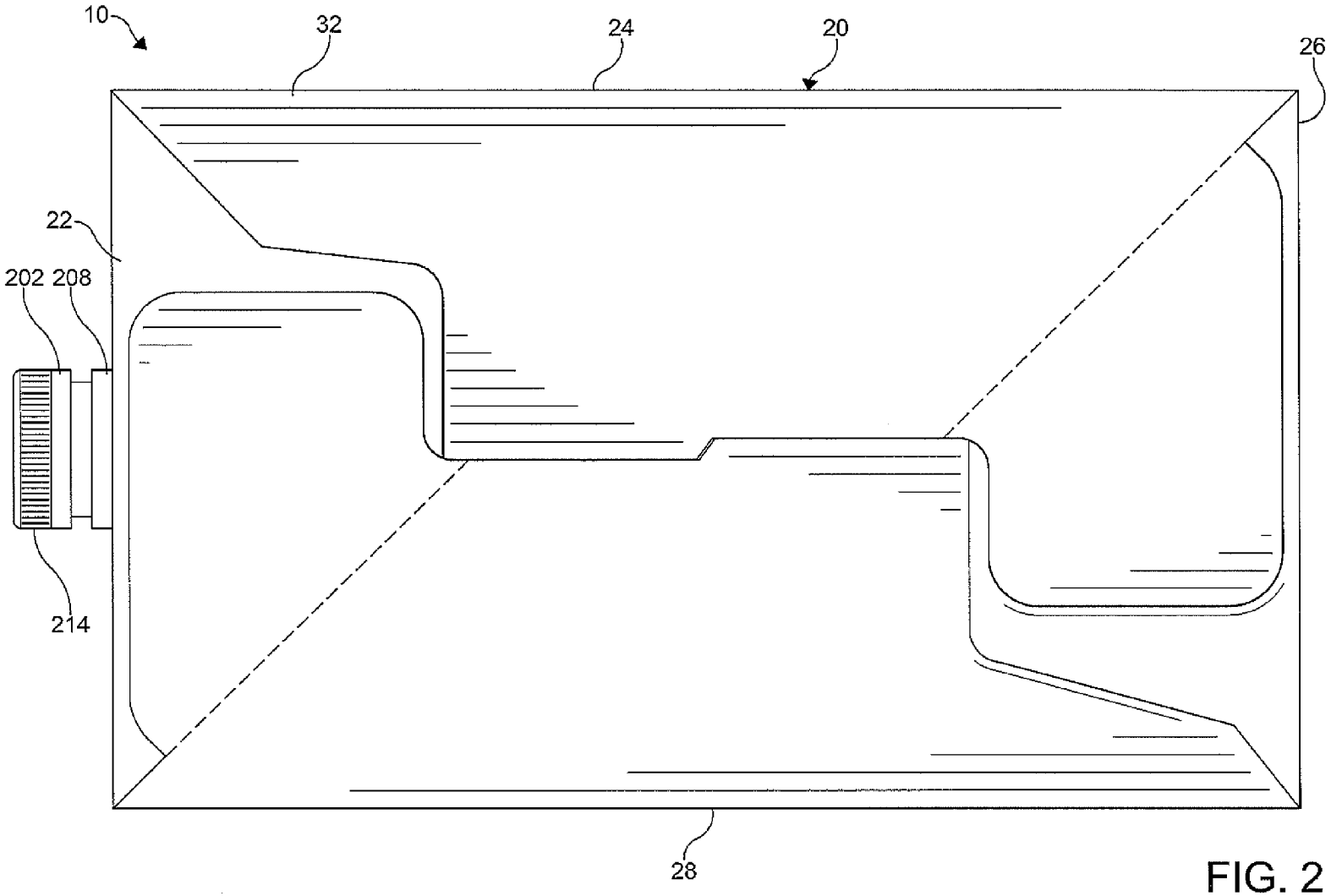
FIG. 2 is a bottom plan view of the beverage container of FIG. 1.
Figure 3:
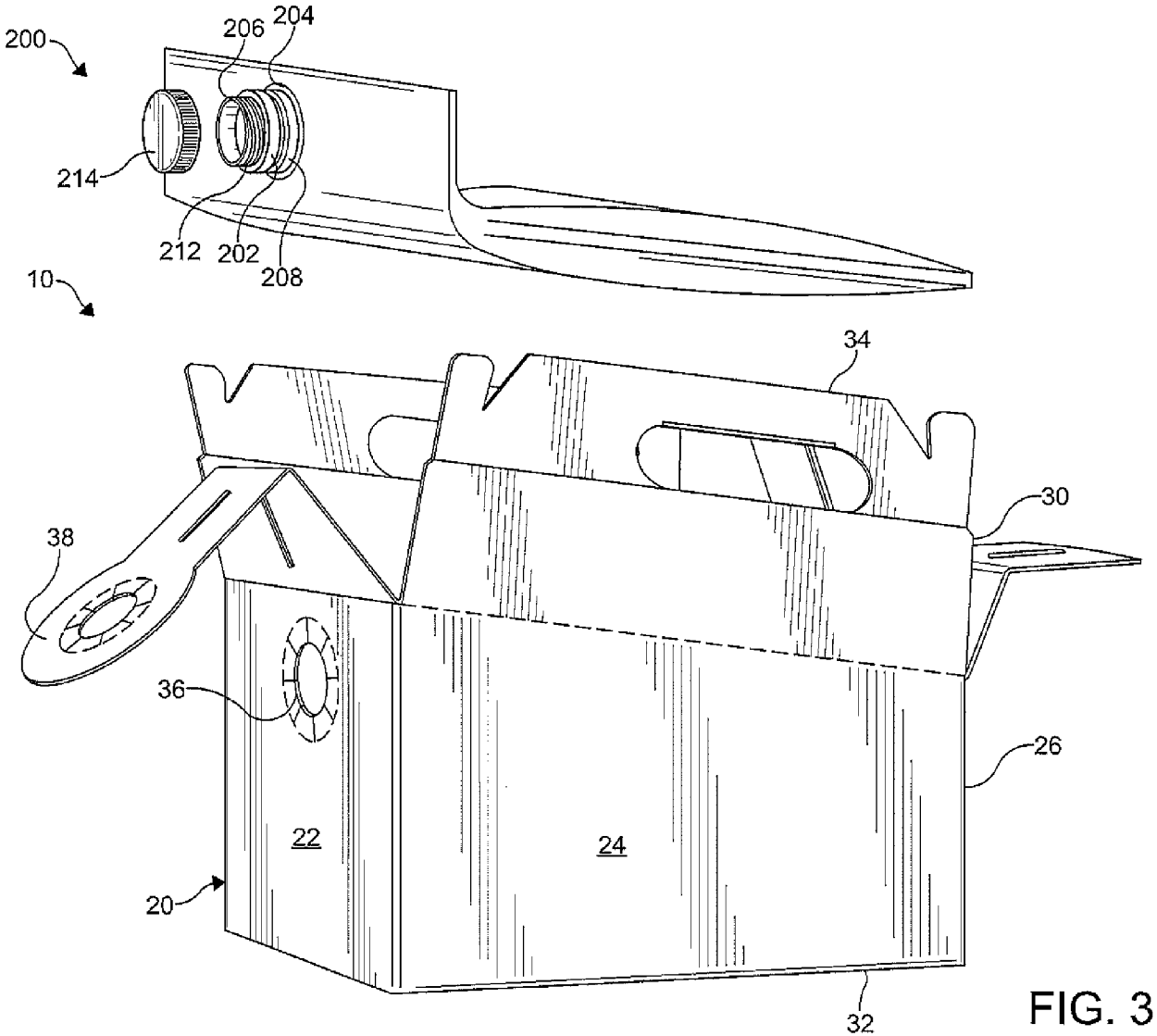
FIG. 3 is a perspective view of the beverage container of FIG. 1 showing the beverage container partially assembled.

Referring now to FIGS. 1-3, there is shown a fluid container 10 according to an embodiment of the invention. The container 10 includes an outer shell 20 and an inner liner 200 having a spout 202. The outer shell 20 of the container 10 includes a plurality of sidewalls 22, 24, 26, 28, a top 30, and a bottom 32 defining a hollow interior. A handle 34 is provided extending outwardly from the top 30. A mouth 36 is formed in the sidewall 22. The inner liner 200 is disposed within the hollow interior of the outer shell 20, wherein the spout 202 is received through the mouth 36 and extends outwardly from the sidewall 22. A security collar 38 is integrally formed with the container 10 and adapted to receive and support the spout 202. In the illustrated embodiment, the container 10 is a four sided container having a substantially rectangular cross-sectional shape. It should be understood that the beverage container 10 can have fewer or additional sides forming other cross-sectional shapes such as a substantially circular, triangular, and octagonal shape, for example. It should also be understood that the handle 34 can be formed on one of the sidewalls 24, 26, 28 of the container 10. It should be further understood that the mouth 36 can be formed in one of the other sidewalls 24, 26, 28 or the top 30. A thermal ink can be disposed on one or more of the sidewalls 22, 24, 26, 28 to provide an indicator of a quantity and a temperature of a fluid within the container 10. For example, a line of the thermal ink can be disposed on one of the sidewalls 22, 24, 26, 28 substantially perpendicular to the bottom 32 to indicate the quantity and temperature of the fluid when the container 10 is resting on the bottom. Additionally, a line of the thermal ink can be disposed on one of the sidewalls 24, 28 substantially parallel to the bottom 32 to indicate the quantity and temperature of the fluid when the container 10 is resting on the sidewall 26 while filling the container 10, for example.

Figure 4:
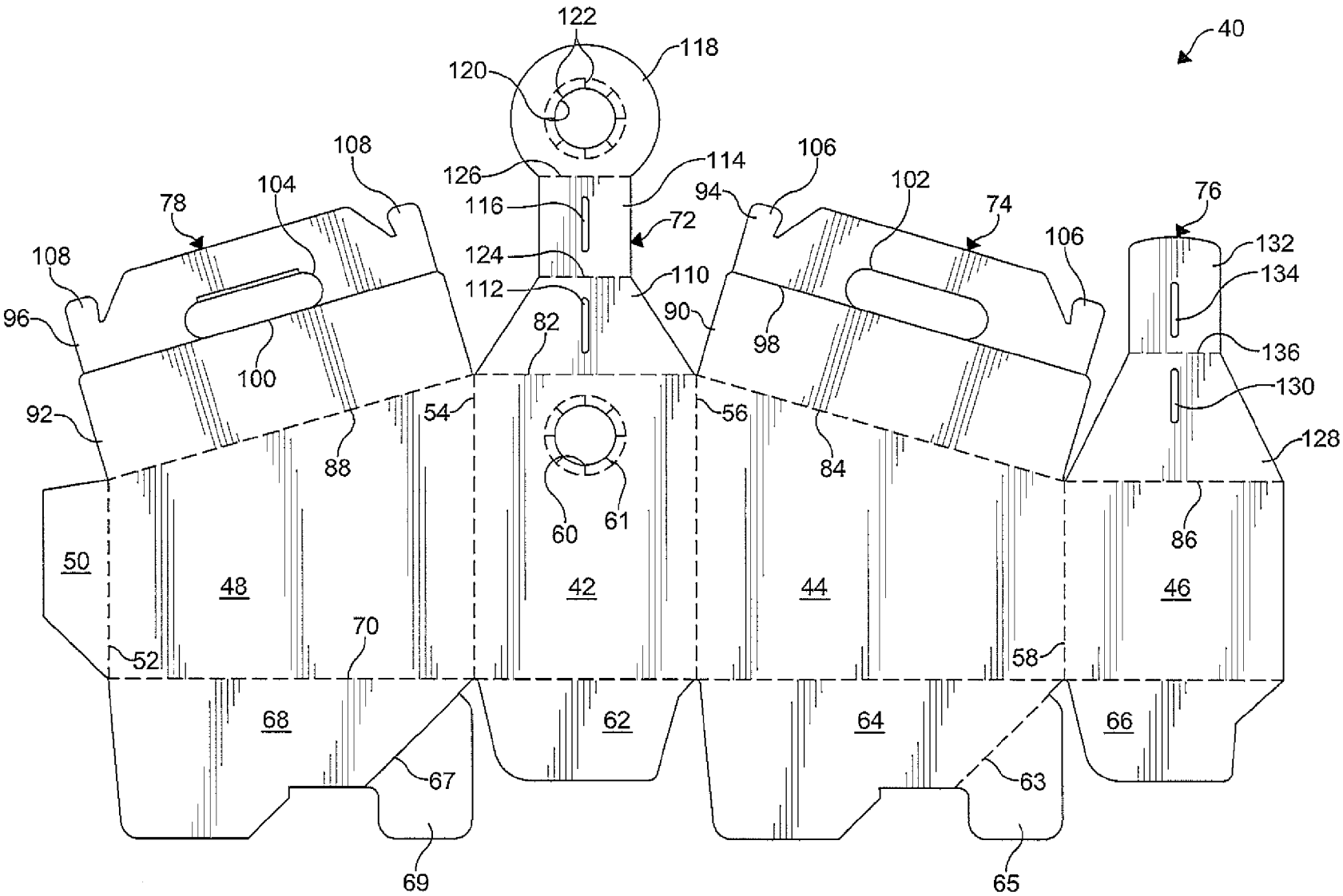
FIG. 4 is a top plan view of a blank from which an outer shell of the beverage container of FIGS. 1-3 is formed.

As shown in FIG. 4, the outer shell 20 is configured to be constructed from a one-piece corrugated blank 40. It should be understood that the outer shell 20 can be formed from other materials such as fiberboard, paper board, corrugated plastics, non-corrugated plastics, and other foldable materials, for example. The blank includes panels 42, 44, 46, 48 for forming the respective sidewalls 22, 24, 26, 28 of the outer shell 20. A tab 50 extends from a side of the panel 48. It should be understood that the tab 50 can be formed on a side of the panel 46. The panels 42, 44, 46, 48 and the tab 50 are hingedly coupled to at least one adjacent panel along fold lines 52, 54, 56, 58. A first opening 60 or retention feature is formed in the panel 42 forming a portion of the mouth 36 of the container 10. An annular array of slits 61 is formed in the panel 42 extending radially outwardly from an edge forming the first opening 60. The slits 61 facilitate receiving the spout 202 of the inner liner 200 through the first opening 60. It should be understood that the first opening 60 and the slits 61 can be formed in the panels 44, 46, 48.

A plurality of bottom flaps 62, 64, 66, 68 depend from bottom edges of the panels 42, 44, 46, 48, respectively. The bottom flaps 62, 64, 66, 68 are hingedly coupled to the respective panels 42, 44, 46, 48 along a fold line 70. Bottom tabs 65, 69 are formed on the bottom flaps 64, 68, respectively. The bottom tabs 65 are hingedly coupled to the respective bottom flaps 64, 66 along fold lines 63, 67. The bottom tab 65 is coupled to the bottom flap 66 and the bottom tab 69 is coupled to the bottom flap 62 in the assembled container 10. The bottom flaps 62, 64, 66, 68 cooperate to form the bottom 32 of the outer shell 20 as clearly shown in FIG. 2.

A plurality of top flaps 72, 74, 76, 78 extend from top edges of the panels 42, 44, 46, 48, respectively. The top flaps 72, 74, 76, 78 are hingedly coupled to the respective panels 42, 44, 46, 48 along fold lines 82, 84, 86, 88. The top flaps 72, 74, 76, 78 cooperate to form the top 30 and the handle 34 of the outer shell 20. The top flaps 74, 78 include a top portion 90, 92 and a handle portion 94, 96, respectively. The handle portions 94, 96 are hingedly coupled to the respective top portions 90, 92 along fold lines 98, 100, respectively. Apertures 102, 104 are formed in the respective handle portions 94, 96 to facilitate a person grasping the handle 34 of the container 10. The handle portions 94, 96 also include tab members 106, 108 to facilitate forming the handle 34 of the container 10. It should be understood that the first opening 60 and the slits 61 can be formed in the top flaps 74, 78 forming the top 30 of the container 10.

The top flap 72 includes a first handle portion 110 having a first slot 112 formed therein, a second handle portion 114 having a second slot 116 formed therein, and a spout retention member 118 forming at least a portion of the security collar 38. As shown, the spout retention member 118 includes a second opening 120 formed therein. An annular array of slits 122 is formed in the spout retention member 118 extending radially outwardly from an edge forming the second opening 120. The slits 122 facilitate receiving the spout 202 of the inner liner 200 through the second opening 120. The first handle portion 110 and the second handle portion 114 are hingedly coupled along a fold line 124, wherein the top flap 72 can be folded along the fold line 124 to position the slots 112, 116 in substantial alignment for receiving the tab members 106, 108 of the handle portions 94, 96. The spout retention member 118 is hingedly coupled to the second handle portion 114 along a fold line 126, wherein the top flap 72 can be further folded along the fold line 126 to position the second opening 120 in substantial alignment with the first opening 60 formed in panel 42. It should be understood that a substantially fluid impervious layer such as a film and a coating, for example, can be disposed on a surface of the spout retention member 118 to militate against fluids from contacting the material forming the spout retention member 118. It should be further understood that the substantially fluid impervious layer may be disposed on a surface of the panels 42, 44, 46, 48, the bottom flaps 62, 64, 66, 68, and the top flaps 72, 74, 76, 78.

The top flap 76 includes a first handle portion 128 having a first slot 130 formed therein and a second handle portion 132 having a second slot 134 formed therein. The first handle portion 128 and the second handle portion 132 are hingedly coupled along a fold line 136, wherein the top flap 76 can be folded along the fold line 136 to position the slots 130, 134 in substantial alignment for receiving the tab members 106, 108 of the handle portions 94, 96.

The inner liner 200 shown in FIG. 3 is configured to receive and store a fluid. The spout 202 provides fluid communication into and out of an interior of the inner liner 200 to facilitate receiving and dispensing the fluid. In the illustrated embodiment, the inner liner 200 is one of a bag, a pouch, a bladder, and the like formed from a substantially media impervious material such as a plastic and a foil material, for example. The inner liner 200 may be a multi-layer liner to provide a desired strength, flexibility, and thermal insulation, for example. The spout 202 includes a base 204 and a distal end 206. An annular rib 208 is formed on an exterior surface of the spout 202 spaced apart from the base 204. As shown in FIG. 1, the edges forming the first opening 60 in the panel 42 and the second opening 120 formed in the spout retention member 118 are received between the annular rib 208 and the base 204. The distal end 206 of the spout 202 includes a thread 212 formed thereon for threadably receiving a cap 214. The cap 214 forms a substantially fluid tight seal with the distal end 206 to facilitate retaining the fluid within the inner liner 200. The spout 202 and the cap 214 can also include a valve, an extension, a dispensing spigot, and other members to facilitate selectively dispensing the fluid therefrom. It should be understood that the inner liner 200 may be coupled to an interior surface of one or more of the sidewalls 22, 24, 26, 28 to facilitate securing the inner liner 200 in a desired position within the outer shell 20 and expanding the inner liner 200 during the final forming of the container 10.

To form the container 10, the blank 40 is folded along the fold lines 52, 54, 56, 58 and the tab 50 of the panel 48 is coupled to a surface of the panel 46 along an edge thereof to form a substantially rectangular shape. The bottom tab 65 is coupled to the bottom flap 66 and the bottom tab 69 is coupled to the bottom flap 62 to form the bottom 32 of the outer shell 20. The bottom 32 is adapted to allow the partially formed container 10 to be collapsed into a substantially flat configuration to minimize a space required to store the container 10. The tab 50 and the bottom tabs 65, 69 can be fastened to the respective panels 46, 66, 62 employing a double sided tape, an adhesive, and other fastening means having suitable physical, chemical, and thermal properties, for example.

The top flap 72 is then folded along fold line 124 to substantially align the second opening 120 formed in the spout retention member 118 with the first opening 60 formed in the panel 42. By folding the top flap 72 along fold line 124, the slot 114 is also placed in substantial alignment with the slot 112. In the illustrated embodiment, the top flap 72 is folded to position the spout retention member 118 on an exterior surface of the container 10. It should be understood that the top flap 72 can be folded to position the spout retention member 118 on an interior surface of the container 10. The inner liner 200 is positioned between the panels 42, 44, 46, 48 and the spout 202 inserted through the first opening 60 and the second opening 120. The edges forming the first opening 60 and the second opening 120 are received between the annular rib 208 and the base 204 of the spout 202. The spout retention member 118 cooperates with the first opening 60 to support the spout 202 in a position extending outwardly from the panel 42. The inner liner 200 can be fastened to a surface of one or more of the panels 42, 44, 46, 48, the bottom flaps 62, 64, 66, 68, and the top flaps 72, 74, 76, 78 employing a double sided tape, an adhesive, and other fastening means, for example. It should be understood that at this stage of forming the container 10, the container 10 can be collapsed to a generally flat configuration to facilitate shipment and storage thereof in case packs and pallets, for example. The final forming of the container 10 can be completed just prior to using the container 10 for storing, transporting, and dispensing a fluid.

The handle 34 of the container 10 can then be formed by folding the top flaps 74, 78 along fold lines 84, 88, respectively, to position the top portions 90, 92 substantially perpendicular to panels 44, 48. The handle portions 94, 96 are then folded along fold lines 98, 100, respectively, to position the handle portions 94, 96 substantially perpendicular to the top portions 90, 92. In this configuration, the top portions 90, 92 form the top 30 of the outer shell 20 and the handle portions 94, 96 abut placing the apertures 102, 104 and the tab members 106, 108 in substantial alignment. The top flap 72 is folded along fold lines 82, 126 to cause the tabs 106, 108 to be received in the slots 112, 116. The top flap 76 is folded along fold lines 86, 136 to cause the tabs 106, 108 to be received in the slots 130, 134 to complete the formation of the handle 34 of the container 10.

Once the container 10 is formed, the inner liner 200 can be filled with a fluid such as coffee, for example. Typically, the cap 214 is removably disposed on the spout 202 to facilitate storing the fluid within the inner liner 200. A person can grasp the handle 34 to facilitate carrying the container 10. When dispensing the fluid from the container, the person can remove the cap 214 from the spout 202, grasp the handle 34, and tilt the container 10 to cause the fluid to flow from the interior of the inner liner 200, through the spout 202, and into an associated receptacle such as a cup, for example. It can be appreciated by one skilled in the art that the position of the spout 202 extending from the outer shell 20 minimizes a required tilting of the container 10 in order to dispense a fluid into a cup.

The container 10 includes the security collar 38 that maximizes a support for the spout 202 of the inner liner 200. Additionally, by forming the security collar in the top flap 72 coupled to the panel 42, an ease of assembling the beverage container 10 is maximized and a material needed to form the container 10 is minimized. Further, by connecting the security collar 38 to the handle 34, the support of the spout 202 is maximized.

Figure 5:
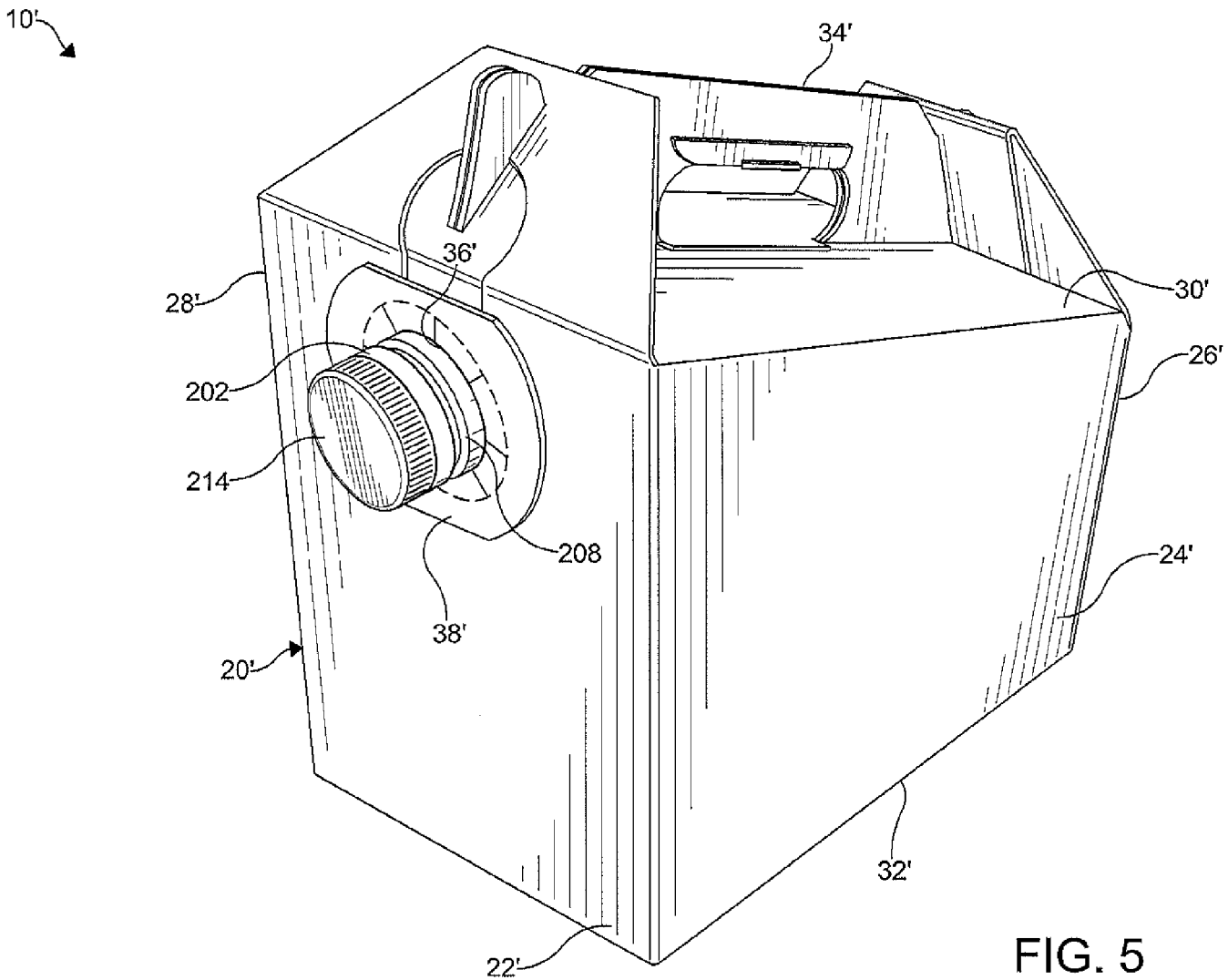
FIG. 5 is a perspective view of a beverage container according to another embodiment of the invention.
Figure 6:
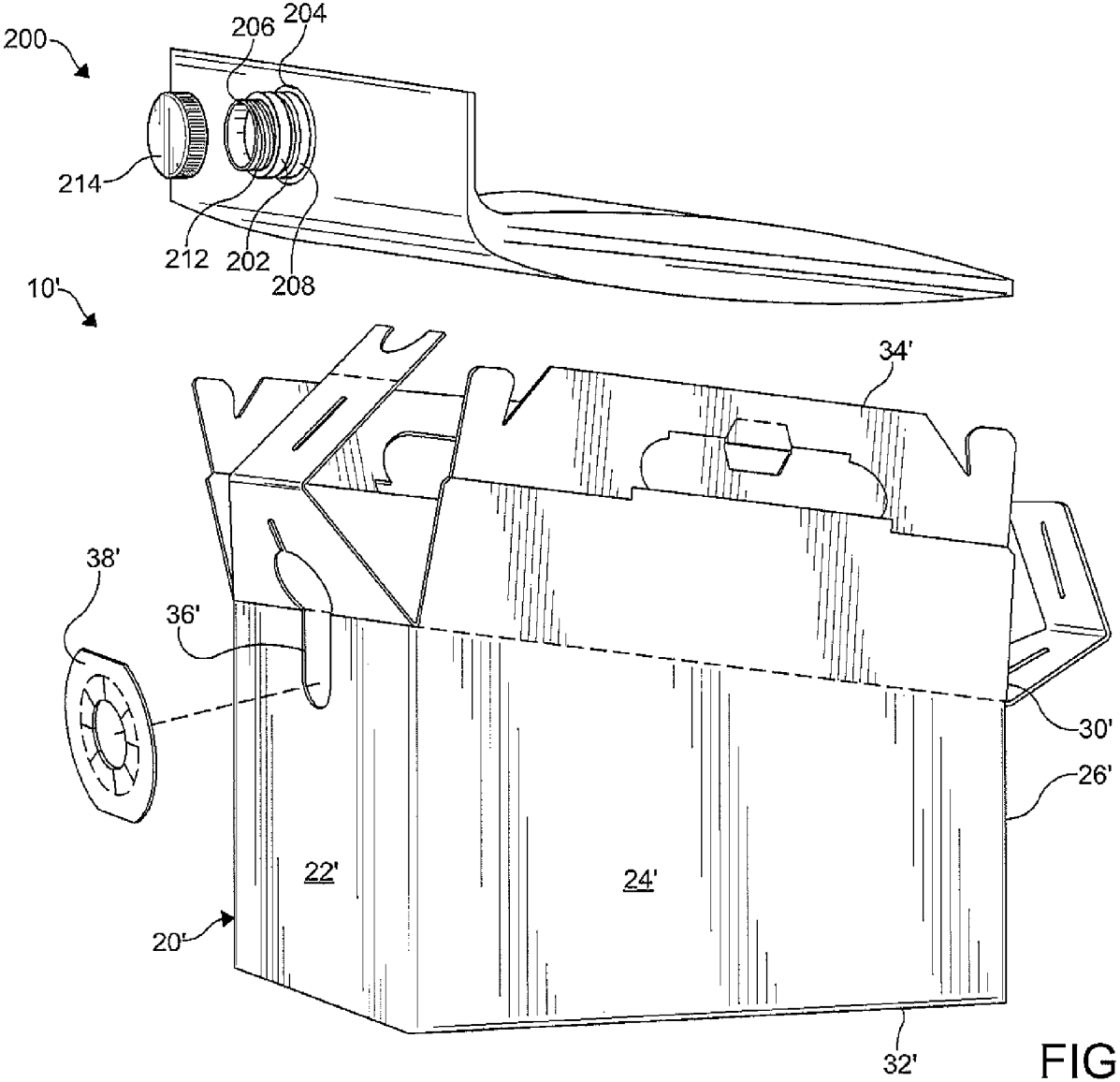
FIG. 6 is a perspective view of the beverage container of FIG. 5 showing the beverage container partially assembled.

Referring now to FIGS. 5-6, there is shown a fluid container 10' according to an embodiment of the invention similar to the fluid container 10, except as described below. The container 10' includes an outer shell 20' for receiving the inner liner 200 having the spout 202. The outer shell 20' of the container 10' includes a plurality of sidewalls 22', 24', 26', 28', a top 30', and a bottom 32' defining a hollow interior. A handle 34' is provided extending outwardly from the top 30'. A mouth 36' is formed in the sidewall 22'. The inner liner 200 is disposed within the hollow interior of the outer shell 20', wherein the spout 202 is received through the mouth 36' and extends outwardly from the sidewall 22'. A security collar 38' is disposed adjacent the sidewall 22' and adapted to receive and support the spout 202. In the illustrated embodiment, the container 10' is a four sided container having a substantially rectangular cross-sectional shape. It should be understood that the beverage container 10' can have fewer or additional sides forming other cross-sectional shapes such as a substantially circular, triangular, and octagonal shape, for example. It should also be understood that the handle 34' can be formed on one of the sidewalls 22', 24', 26', 28' of the container 10'. It should be further understood that the mouth 36' can be formed in one of the other sidewalls 24', 26', 28' or the top 30'. A thermal ink can be disposed on one or more of the sidewalls 22', 24', 26', 28' to provide an indicator of a quantity and a temperature of a fluid within the container 10'. For example, a line of the thermal ink can be disposed on one of the sidewalls 22', 24', 26', 28' substantially perpendicular to the bottom 32' to indicate the quantity and temperature of the fluid when the container 10' is resting on the bottom. Additionally, a line of the thermal ink can be disposed on one of the sidewalls 24', 28' substantially parallel to the bottom 32' to indicate the quantity and temperature of the fluid when the container 10' is resting on the sidewall 26' while filling the container 10', for example.

Figure 7:
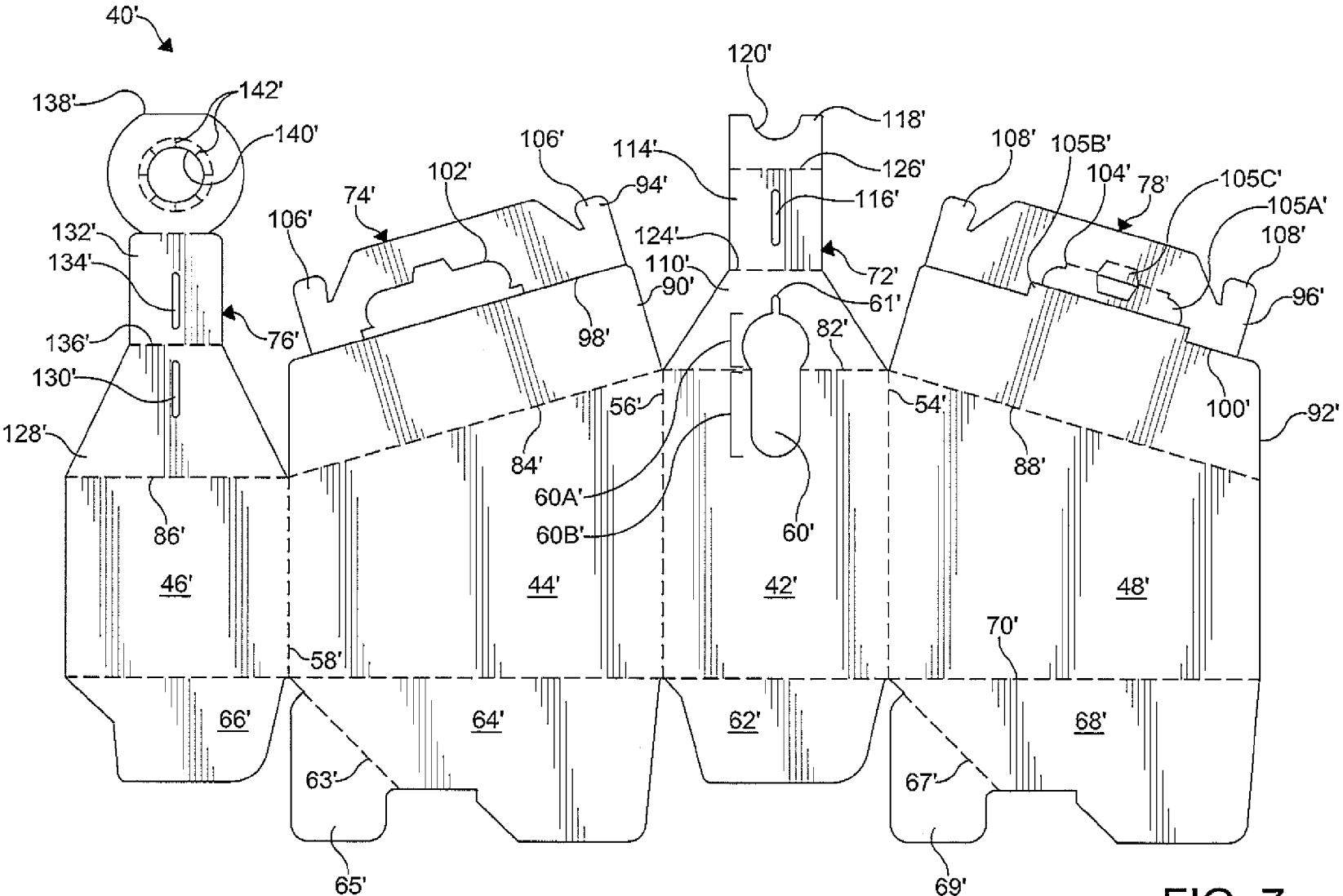
FIG. 7 is a top plan view of a blank from which an outer shell of the beverage container of FIGS. 5-6 is formed.

As shown in FIG. 7, the outer shell 20' is configured to be constructed from a one-piece corrugated blank 40'. It should be understood that the outer shell 20' can be formed from other materials such as fiberboard, paper board, corrugated plastics, non-corrugated plastics, and other foldable materials, for example. The blank includes panels 42', 44', 46', 48' for forming the respective sidewalls 22', 24', 26', 28' of the outer shell 20'. The panels 42', 44', 46', 48' are hingedly coupled to each other along fold lines 54', 56', 58'. A first opening 60' is at least partially formed in the panel 42' and defines at least a portion of the mouth 36' of the container 10'. As a non-limiting example, the first opening 60' has a generally keyhole shape having a generally circular section 60A' and a generally elliptical section 60B'. A slit 61' extends radially outwardly from the generally circular section 60A'. The slit 61' may also be formed in the generally elliptical section 60B', if desired. It should be understood that the first opening 60' and the slit 61' can be at least partially formed in the panels 44', 46', 48'.

A plurality of bottom flaps 62', 64', 66', 68' depend from bottom edges of the panels 42', 44', 46', 48', respectively. The bottom flaps 62', 64', 66', 68' are hingedly coupled to the respective panels 42', 44', 46', 48' along a fold line 70'. Bottom tabs 65', 69' are formed on the bottom flaps 64', 68', respectively. The bottom tabs 65' are hingedly coupled to the respective bottom flaps 64', 66' along fold lines 63', 67'. The bottom tab 65' is coupled to the bottom flap 66' and the bottom tab 69' is coupled to the bottom flap 62' in the assembled container 10'. The bottom flaps 62', 64', 66', 68' cooperate to form the bottom 32' of the outer shell 20'.

A plurality of top flaps 72', 74', 76', 78' extend from top edges of the panels 42', 44', 46', 48', respectively. The top flaps 72', 74', 76', 78' are hingedly coupled to the respective panels 42', 44', 46', 48' along fold lines 82', 84', 86', 88'. The top flaps 72', 74', 76', 78' cooperate to form the top 30' and the handle 34' of the outer shell 20'. The top flaps 74', 78' include a top portion 90', 92' and a handle portion 94', 96', respectively. The handle portions 94', 96' are hingedly coupled to the respective top portions 90', 92' along fold lines 98', 100', respectively. Apertures 102', 104' are formed in the respective handle portions 94', 96' to facilitate a person grasping the handle 34' of the container 10'. As a non-limiting example, a foldable first tab 105A' extends from the handle portion 96' across the aperture 104' and toward the top portion 92' of the top flap 78'. In certain embodiments, a locking tab 105C' extends from a portion of the handle portion 96' and is disposed between the handle portion 96' and the first tab 105A'. As a further non-limiting example, a second tab 105B' extends from an edge of the top portion 92' toward the first tab 105A', when the blank 40' is unfolded and flat. In the embodiment shown, the handle portions 94', 96' also include tab members 106', 108' to facilitate forming the handle 34' of the container 10'. As shown, the tab members 106', 108' are configured to extend from the respective handle portions 94', 96', but not beyond a projected plane of one of the peripheral edge of a respective one of the panels 44', 48', when the blank 40' is in an unfolded position.

The top flap 72' includes a first handle portion 110', a second handle portion 114' having a slot 116' formed therein, and a spout retention member 118' having a retention feature 120' formed therein. As a non-limiting example, the retention feature 120' is a semi-circular opening or notch formed adjacent an edge of the spout retention member 118'. However, it is understood that the retention feature 120' can have any shape and size.

In certain embodiments, at least a portion (e.g. the generally circular section 60A') of the first opening 60' is formed in the first handle portion 110'. As a non-limiting example, the slit 61' is formed in the first handle portion 110' and is substantially aligned with the slot 116' formed in the second handle portion 114'.

In the embodiment shown, the first handle portion 110' and the second handle portion 114' are hingedly coupled along a fold line 124', wherein the top flap 72' can be folded along the fold line 124' to position the slots 112', 116' in substantial alignment for receiving the tab members 106', 108' of the handle portions 94', 96'. The spout retention member 118' is hingedly coupled to the second handle portion 114' along a fold line 126', wherein the top flap 72' can be further folded along the fold line 126' to position the retention feature 120' in substantial alignment with a portion of the first opening 60' formed in the panel 42'. It should be understood that a substantially fluid impervious layer such as a film and a coating, for example, can be disposed on a surface of the spout retention member 118' to militate against fluids from contacting the material forming the spout retention member 118'. It should be further understood that the substantially fluid impervious layer may be disposed on a surface of the panels 42', 44', 46', 48', the bottom flaps 62', 64', 66', 68', and the top flaps 72', 74', 76', 78'.

The top flap 76' includes a first handle portion 128' having a first slot 130' formed therein and a second handle portion 132' having a second slot 134' formed therein. The first handle portion 128' and the second handle portion 132' are hingedly coupled along a fold line 136', wherein the top flap 76' can be folded along the fold line 136' to position the slots 130', 134' in substantial alignment for receiving the tab members 106', 108' of the handle portions 94', 96'. As a non-limiting example a detachable spout securing member 138' is releasably coupled to an edge of the second handle portion 132'. It is understood that the spout securing member 138' forms at least a portion of the security collar 38'. As shown, the spout securing member 138' includes an opening 140' formed therein. An annular array of slits 142' is formed in the spout securing member 138' extending radially outwardly from an edge forming the opening 140'. The slits 142' facilitate receiving the spout 202 of the inner liner 200 through the opening 140'.

To form the container 10', the blank 40' is folded along the fold lines 54', 56', 58' and the panel 48' is coupled to a surface of the panel 46' along an edge thereof to form a substantially rectangular shape. The bottom tab 65' is coupled to the bottom flap 66' and the bottom tab 69' is coupled to the bottom flap 62' to form the bottom 32' of the outer shell 20'. The bottom 32' is adapted to allow the partially formed container 10' to be collapsed into a substantially flat configuration to minimize a space required to store the container 10'. The bottom tabs 65', 69' can be fastened to the respective panels 46', 66', 62' employing a double sided tape, an adhesive, and other fastening means having suitable physical, chemical, and thermal properties, for example.

The inner liner 200 is positioned between the panels 42', 44', 46', 48' and the spout 202 inserted through the generally circular section 60A' of the first opening 60'. Specifically, the edge forming the first opening 60' is received between the annular rib 208 and the base 204 of the spout 202. The spout 202 is then guided into the generally elliptical section 60B' of the first opening 60'. The first and second handle portions 110', 114' are then folded along fold lines 124', 126' to allow the retention feature 120' to abut a portion of the spout 202. As a non-limiting example, the second handle portion 114' is folded upon the first handle portion 110' to overlay a portion of the slit 116' with the slit 61'. As a further non-limiting example, the first and second handle portions 110', 114' are folded to position the spout retention member 118' in an interior of the outer shell 20'. It is understood that the spout retention member 118' cooperates with the first opening 60' to support the spout 202 in a position extending outwardly from the panel 42'. In certain embodiments, the edges forming the first opening 60' in the panel 42' and the retention feature 120' formed in the spout retention member 118' are received between the annular rib 208 and the base 204. It should be understood that the inner liner 200 may be coupled to an interior surface of one or more of the sidewalls 22', 24', 26', 28' to facilitate securing the inner liner 200 in a desired position within the outer shell 20' and expanding the inner liner 200 during the final forming of the container 10'. It should be further understood that the inner liner 200 can be fastened to a surface of one or more of the panels 42', 44', 46', 48', the bottom flaps 62', 64', 66', 68', and the top flaps 72', 74', 76', 78' employing a double sided tape, an adhesive, and other fastening means, for example.

It should be understood that at this stage of forming the container 10', the container 10' can be collapsed to a generally flat configuration to facilitate shipment and storage thereof in case packs and pallets, for example. The final forming of the container 10' can be completed just prior to using the container 10' for storing, transporting, and dispensing a fluid.

The handle 34' of the container 10' can then be formed by folding the top flaps 74', 78' along fold lines 84', 88', respectively, to position the top portions 90', 92' substantially perpendicular to panels 44', 48'. The handle portions 94', 96' are then folded along fold lines 98', 100', respectively, to position the handle portions 94', 96' substantially perpendicular to the top portions 90', 92'. The first tab 105A' can then be folded to extend through the apertures 104', 102' to abut a part of the handle portion 94', thereby allowing a user to comfortably grip both of the handle portion 94', 96' together. Specifically, the first tab 105A' can be folded through the apertures 104', 102' and folded around a part of the handle portion 94'. The locking tab 105C' can then be folded through the apertures 104', 102' to engage the first tab 105A' and secure the first locking tab 105A' in position. While the handle portions 94', 96' are positioned substantially perpendicular to the top portions 90', 92', the second tab 105B' extends from the top portion 92' and overlays a portion of the top portion 90'. It is understood that the second tab 105B' can cover a space formed between the top portions 90', 92' when the fluid container 10' is assembled.

In this configuration, the top portions 90', 92' form the top 30' of the outer shell 20' and the handle portions 94', 96' abut placing the apertures 102', 104' and the tab members 106', 108' in substantial alignment. The top flap 72' is folded along fold lines 82', 126' to cause the tabs 106', 108' to be received in the slots 61', 116'. The top flap 76' is folded along fold lines 86', 136' to cause the tabs 106', 108' to be received in the slots 130', 134' to complete the formation of the handle 34' of the container 10'. In certain embodiments, the spout securing member 138' (i.e. the security collar 38') is detached from the second handle portion 132' and is circumferentially disposed around the spout 200 protruding from the outer shell 20'.

Once the container 10' is formed, the inner liner 200 can be filled with a fluid such as coffee, for example. Typically, the cap 214 is removably disposed on the spout 202 to facilitate storing the fluid within the inner liner 200. A person can grasp the handle 34' to facilitate carrying the container 10'. When dispensing the fluid from the container, the person can remove the cap 214 from the spout 202, grasp the handle 34', and tilt the container 10' to cause the fluid to flow from the interior of the inner liner 200, through the spout 202, and into an associated receptacle such as a cup, for example.

The container 10, 10' including the retention feature 120, 120' and the security collar 38, 38' maximizes a support for the spout 202 of the inner liner 200. Additionally, by forming the security collar in the top flap 72, 72' coupled to the panel 42, 42', an ease of assembling the beverage container 10, 10' is maximized and a material needed to form the container 10, 10' is minimized. Further, by connecting the retention feature 120, 120' to the handle 34, 34', the support of the spout 202 is maximized.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A fluid container comprising:

an outer shell including a plurality of sidewalls forming a hollow interior, a first one of the sidewalls having an opening formed therein and a first flap extending therefrom, the first flap having a retention feature formed therein; and an inner liner disposed within the hollow interior of the outer shell configured to receive and store a fluid, the inner liner including a spout providing fluid communication with an interior thereof; wherein the first flap includes at least one fold line about which the first flap is folded upon itself to position the retention feature in substantial alignment with a portion of the opening formed in the first one of the sidewalls, the opening and the retention feature cooperating to receive and support the spout in a position extending outwardly from the first one of the sidewalls.

2. The fluid container according to claim 1, wherein the outer shell is formed from a one-piece corrugated blank.

3. The fluid container according to claim 1, wherein the retention feature is a circular opening.

4. The fluid container according to claim 1, wherein the retention feature is a semi-circular notch formed adjacent an edge of the first flap.

5. The fluid container according to claim 1, further comprising an annular array of slits formed in the first one of the sidewalls extending generally radially outwardly from the opening.

6. The fluid container according to claim 1, further comprising an annular array of slits formed in the first flap extending generally radially outwardly from the retention feature.

7. The fluid container according to claim 1, wherein the outer shell includes a second flap extending from a second one of the sidewalls opposite the first one of the sidewalls, the second flap including at least one slit formed therein.

8. The fluid container according to claim 7, wherein the outer shell includes a third flap extending from a third one of the sidewalls adjacent the first one of the sidewalls, the third flap including a handle portion with a tab extending therefrom, the tab configured to be received in the at least one slit formed in the second flap.

9. The fluid container according to claim 7, wherein the outer shell includes a third flap extending from a third one of the sidewalls adjacent the first sidewall, the third flap including a handle portion with a tab extending therefrom, the tab configured to be received in a slit formed in the first flap.

10. A fluid container comprising:

an outer shell including a plurality of sidewalls forming a hollow interior, a first one of the sidewalls having a first flap extending therefrom, wherein the first flap has a retention feature formed therein, and an opening is formed in at least a portion of the first one of the sidewalls; and an inner liner disposed within the hollow interior of the outer shell configured to receive and store a fluid, the inner liner including a spout providing fluid communication into an interior thereof, wherein the spout is positioned to extend through the opening formed in the at least portion of the first one of the sidewalls and the first flap includes at least one fold line about which the first flap is folded upon itself to position the retention feature around at least a portion of the spout, the opening and the retention feature cooperating to support the spout in a position extending outwardly from the first one of the sidewalls.

11. The fluid container according to claim 10, wherein the retention feature is a circular opening having at least one slit extending radially outwardly therefrom.

12. The fluid container according to claim 10, wherein the retention feature is a semi-circular notch formed adjacent an edge of the first flap.

13. The fluid container according to claim 10, wherein the opening formed in the at least one of the first one of the sidewalls and the first flap is generally key-hole shaped.

14. The fluid container according to claim 10, further comprising a slit formed in the first flap and extending generally radially outwardly from the opening.

15. The fluid container according to claim 10, wherein the outer shell includes a second flap extending from a second one of the sidewalls opposite the first one of the sidewalls, the second flap including at least one slit formed therein.

16. The fluid container according to claim 15, wherein the outer shell includes a third flap extending from a third one of the sidewalls adjacent the first one of the sidewalls, the third flap including a handle portion with a tab extending therefrom, the tab configured to be received in the at least one slit formed in the second flap.

17. The fluid container according to claim 15, wherein the outer shell includes a third flap extending from a third one of the sidewalls adjacent the first one of the sidewalls, the third flap including a handle portion with a tab extending therefrom, the tab configured to be received in a slit formed in the first flap.

18. The fluid container according to claim 15, wherein the outer shell includes a third flap extending from a third one of the sidewalls adjacent the first one of the sidewalls and a fourth flap extending from a fourth one of the sidewalls opposite the third one of the sidewalls, each of the third flap and the fourth flap including a handle portion with an aperture formed therein, the third flap including a tab formed adjacent the aperture formed in the third flap and extending to overlay a portion of the fourth flap when the fluid container is assembled.

19. The fluid container according to claim 10, further comprising a security collar releasably coupled to the outer shell, the security collar including a aperture formed therein to receive the spout of the inner liner and support the spout in a position extending outwardly from the first one of the sidewalls.

20. A method of forming a fluid container, the method comprising the steps of providing a blank including a plurality of panels, a first one of the panels having an opening formed therein and a first flap extending from the first one of the panels, wherein the first flap has a retention feature formed therein;

arranging the panels to form an outer shell having a hollow interior;

disposing an inner liner in the hollow interior of the outer shell, the inner liner including a spout providing fluid communication with an interior thereof, wherein the spout is positioned to extend through the opening formed in the first one of the panels; and folding the first flap upon itself to position the retention feature around at least a portion of spout, the opening and the retention feature cooperating to support the spout in a position extending outwardly from the first one of the panels.

* * * * *